United States Patent [19]

Clark

[11] Patent Number: 4,890,339

[45] Date of Patent: Jan. 2, 1990

[54] SPLASH SUPPRESSOR

[76] Inventor: William C. Clark, P.O. Box 2777, Knoxville, Tenn. 37901

[21] Appl. No.: 221,887

[22] Filed: Jul. 20, 1988

[51] Int. Cl.[4] ..... E03D 9/00

[52] U.S. Cl. ..... 4/300.3; 4/319; 181/234

[58] Field of Search ..... 4/300.3, 658, 542, 300, 4/408, 319; 181/233, 234; 210/219

[56] References Cited

U.S. PATENT DOCUMENTS

| | | | |
|---|---|---|---|
| 2,324,018 | 7/1943 | Peterson | 210/219 |
| 2,779,948 | 2/1957 | Houle | 4/319 |
| 3,157,888 | 11/1964 | Violette | 4/319 |
| 3,411,499 | 11/1968 | Jacuzzi | 4/542 |
| 3,491,379 | 1/1970 | Parrish | 4/420 |
| 3,780,384 | 12/1973 | Rivelle | 4/408 |
| 4,086,306 | 4/1978 | Yoshinaga | 210/219 |
| 4,131,959 | 1/1979 | Albertassi et al. | 4/319 |
| 4,338,690 | 7/1982 | Hsieh et al. | 4/300 |
| 4,535,491 | 8/1985 | Young | 4/300.3 |
| 4,665,572 | 5/1987 | Davidson et al. | 4/542 |

FOREIGN PATENT DOCUMENTS

| | | | |
|---|---|---|---|
| 589572 | 12/1959 | Canada | 4/319 |
| 333666 | 3/1921 | Fed. Rep. of Germany | 4/408 |
| 459329 | 9/1950 | Italy | 4/408 |
| 106159 | 5/1917 | United Kingdom | 4/542 |
| 2185763 | 7/1987 | United Kingdom | 4/319 |

*Primary Examiner*—Henry J. Recla
*Assistant Examiner*—R. M. Fetsuga
*Attorney, Agent, or Firm*—Luedeka, Hodges & Neely

[57] ABSTRACT

A device to create such turbulence in water normally held motionless in a toilet that splashing and spattering is suppressed when solids, liquids, or both are inserted in a traditional manner. This device includes a submerged, motor driven rotor which when rotated rapidly causes the desired hydraulic turbulence. Appropriate switches are provided to accommodate the various ways in which a toilet is operated. A mounting bracket for hanging the device on any given toilet is provided. This same bracket also permits adjustment of the rotor's height to achieve proper submersion. A power cord is provided for connecting the splash suppressor to an electrical power source. A fluid resistant housing is provided for the motor and switches. This same housing extends from the motor to form a housing for the submerged rotor.

7 Claims, 3 Drawing Sheets

SPLASH SUPPRESSOR

DESCRIPTION

1. Technical Field

This invention relates generally to a liquid splash suppressor and more specifically to the rest room plumbing fixture commonly referred to as a toilet. A splash suppressor is capable of causing sufficient turbulence in the water contained within a toilet bowl that the incidence of splashing and spattering is suppressed when a substance is dropped on the liquid surface.

2. Summary of the Invention

The present invention provides a toilet accessory or modification to said toilet which causes sufficient turbulence within the water contained within the toilet's bowl that the tendency for splashing and spattering during use is suppressed. Both solids and liquids may be placed in said toilet without causing the annoying and unsanitary splashing and spattering inherent to the modern toilet. It consists of a mounting bracket for attaching said accessory on said toilet bowl rim. The mounting bracket includes a surface provided for removably and adjustably mounting a motor, drive shaft, and rotor assembly at the correct height for proper immersion of the rotor assembly. Said bracket also contains two switches; the first being a side mounted switch for use when the toilet seat is in the down position; the second being a spring activated plunger switch which automatically activates the motor when the seat is raised. The motor, drive shaft, rotor assembly is contained within a housing which removably and adjustably secures the assembly on said mounting bracket. A power cord is provided for connecting the Splash Suppressor to an electrical power source.

DETAILED DESCRIPTION OF THE EMBODIMENT

Figure 1:
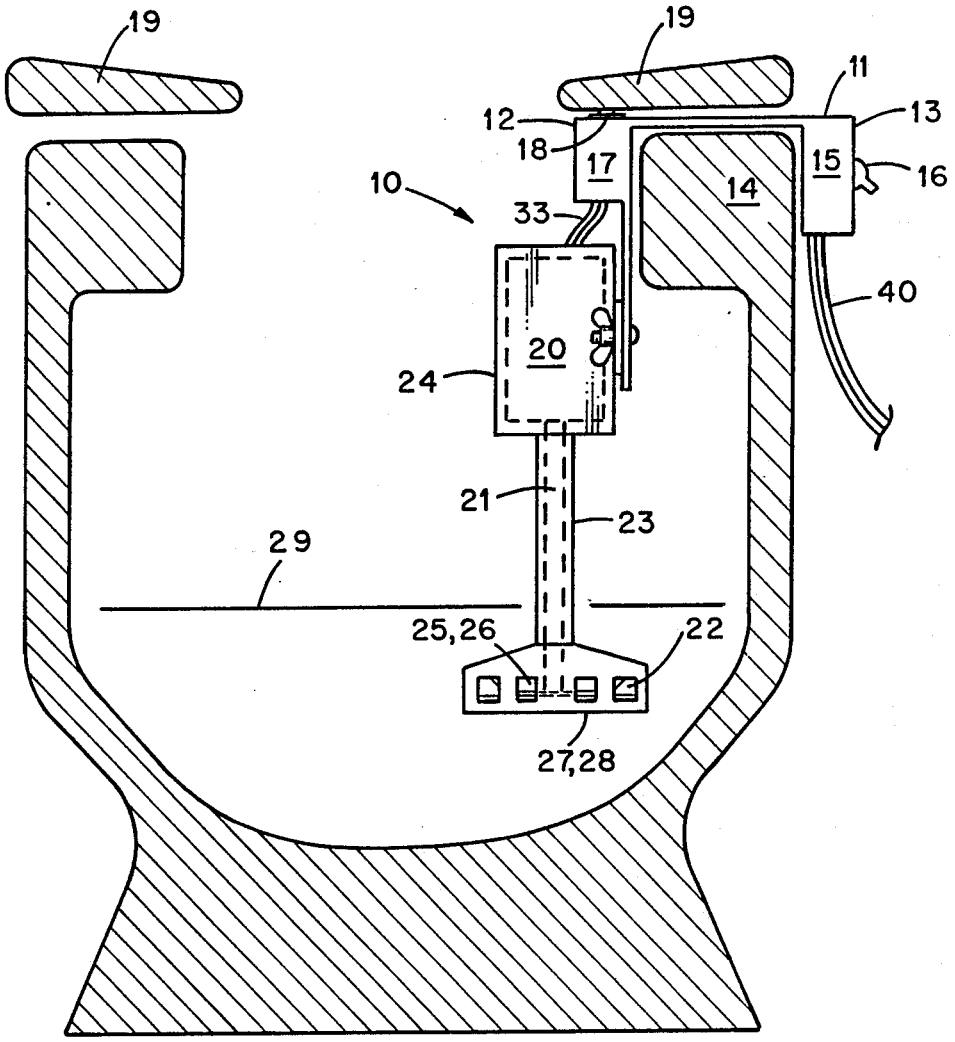
FIG. 1 is a cross-sectional toilet bowl view and Splash Suppressor side view.

Referring to the drawings, and to the embodiment of the invention herein presented by way of illustration, FIG. 1 shows the Splash Suppressor member 10. The Splash Suppressor member 10 consists of a mounting bracket member 11. The mounting bracket member 11 has an inside toilet bowl end 12 and an outside toilet bowl end 13. Said mounting bracket 11 hangs across and removably mounts on toilet bowl rim 14. Mounting bracket member 11 also incorporates two switch housings; the first being the side mounted switch housing 15 for the side mounted switch 16; the second being the seat switch housing 17 for the seat switch 18. The seat switch 18 being a spring actuated type which activates the electric motor 20 any time the seat 19 is raised. The electric motor 20, drive shaft 21, rotor 22, and housing 23 collectively comprise the toilet accessory assembly 24. Said toilet accessory assembly 24 is activated by either the side mounted switch 16 or the seat switch 18 depending on the mode of operation. The housing 23 has water outlet openings 25, each protected with an outlet screen 26. The water inlet opening 27 is also protected with a screen 28. The purpose of screens 26 and 28 is to prevent solids from contacting the rotor 22.

When the motor 22 is activated by either switch 16 or 18, the drive shaft 21 revolves and thereby causes rotor 22 to revolve also. As the rotor 22 rotates underneath water level 29 in a submerged position the desired turbulence is created and maintained until such turbulence is no longer desirable.

Figure 2:
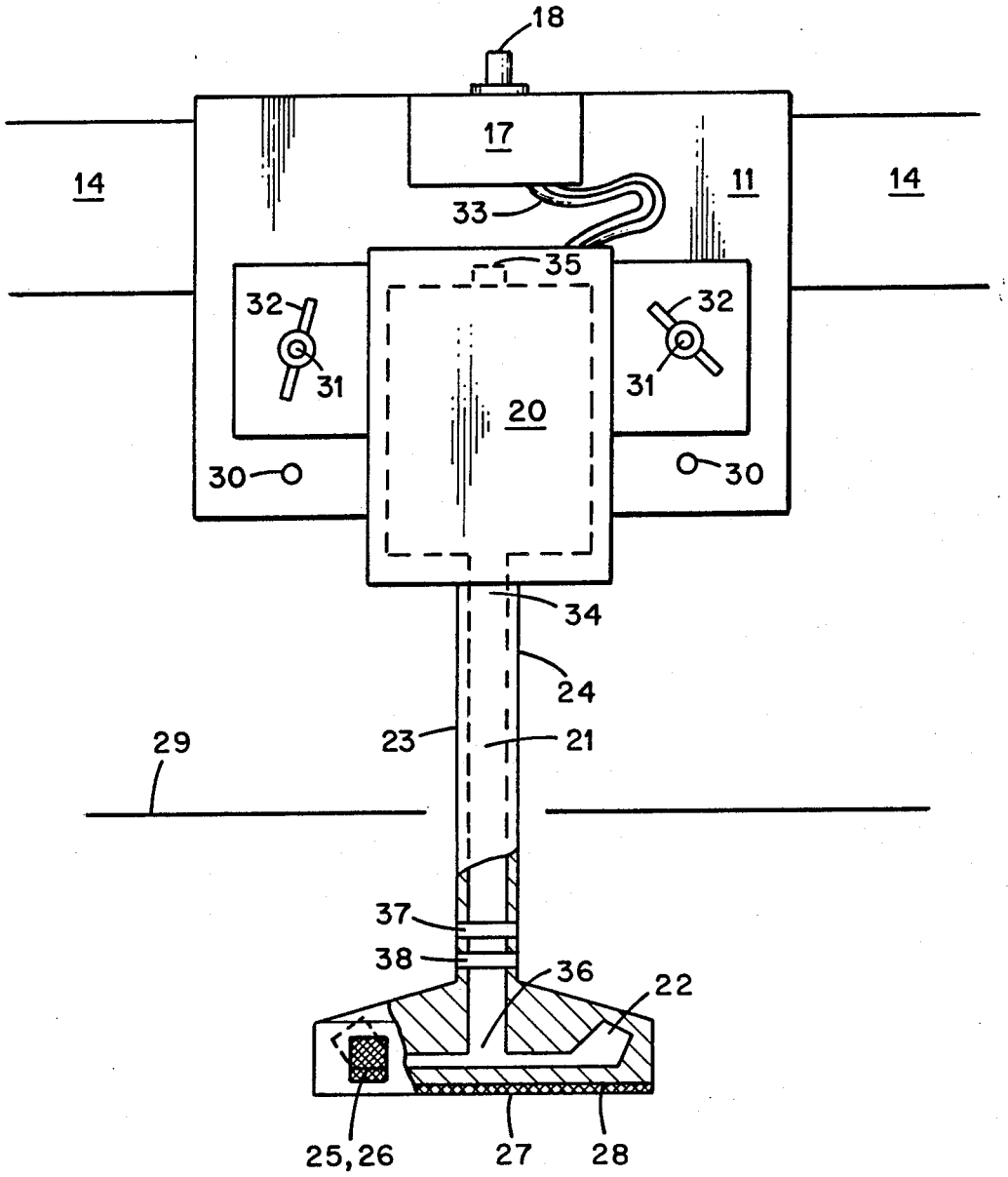
FIG. 2 is a Splash Suppressor frontal view within the toilet bowl, with the splash suppressor shown partly in section.

Referring to FIG. 2, said toilet accessory assembly 24 is removably and adjustably attached to mounting bracket 11 by selecting the openings 30 desired for proper immersion of rotor 22. Assembly 24 is attached to mounting bracket 11 by two screws 31 and a pair of wingnuts 32. FIG. 2 also displays the power cord 33 which carries current from either switch 16 or 18 to the motor 20.

Referring again to FIG. 2, the drive shaft 21 has a first end 34 and a further end 36. The first end 34 is supported and made concentric within housing 23 by being an extension of the armature 35 of electric motor 20. The further end 36 of drive shaft 21 is supported within housing 23 by a spindle bearing 37 which is protected by a hydraulic seal 38.

Figure 3:
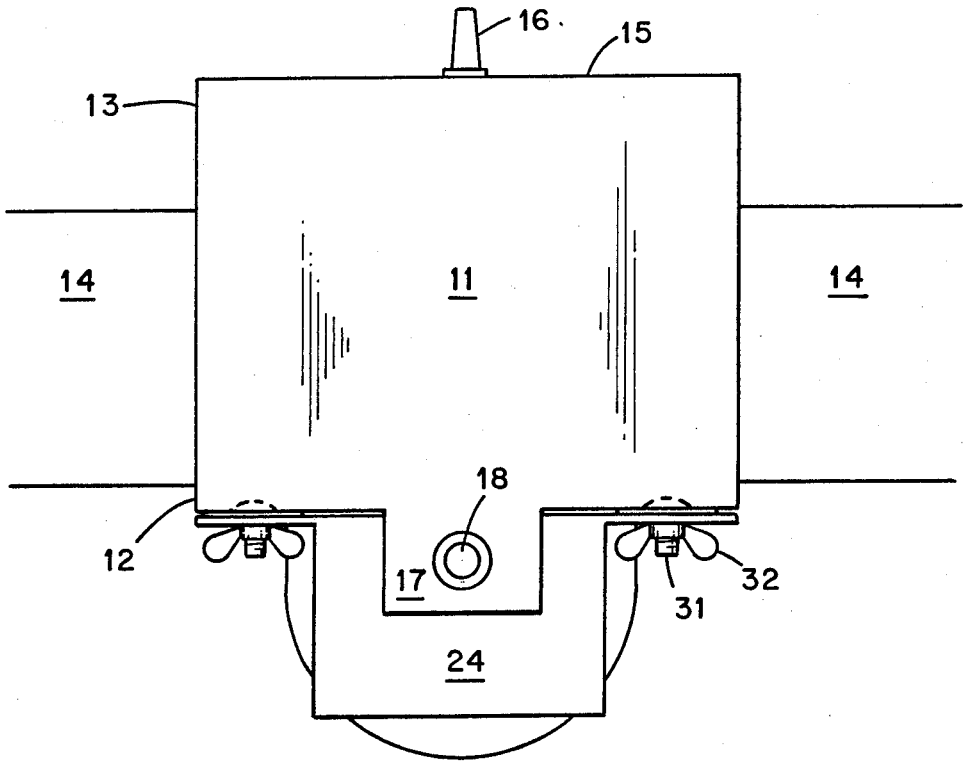
FIG. 3 is a Splash Suppressor top view.

FIG. 3 displays the seat switch 18 and seat switch housing 17.

Figure 4:
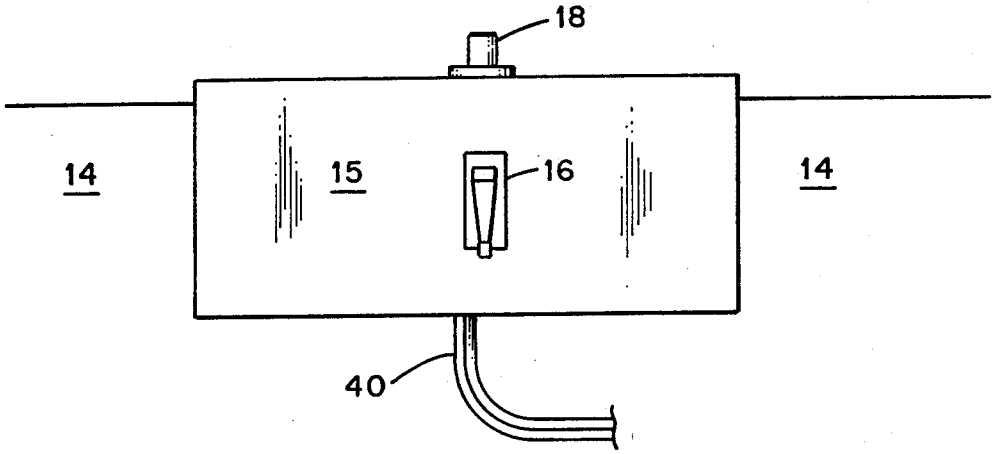
FIG. 4 is a Splash Suppressor mounting bracket as viewed from outside the toilet bowl.

FIG. 4 displays the side mounted switch 16 with the side mounted switch housing 15; as well as the power supply cord 40 which enters the bottom of the side mounted switch housing 15.

While a preferred embodiment has been shown and described, it will be understood that there is no intent to limit the invention to such disclosure, but rather it is intended to cover all modifications and alternate constructions falling within the spirit and scope of the invention as defined in the appended claims.

I claim:

1. A splash suppressor in combination with a toilet bowl containing liquid, said suppressor comprising:

turbulence means including a rotatable impeller for submergence within the liquid of the toilet bowl;

means for rotating said impeller and thereby creating hydraulic turbulence in the toilet bowl liquid to suppress the splashing of liquid when a substance is dropped on the upper surface of the liquid; and a housing associated with said turbulence means having a fluid-impervious portion covering said impeller so that when said impeller is operatively submerged within the liquid and rotated in a manner creating hydraulic turbulence as aforesaid, said fluid-impervious portion is positioned between the rotating impeller and the upper surface of the toilet bowl liquid so as to prevent atmospheric air from being drawn into the liquid and prevent liquid from being thrown above the level of the upper surface by the rotating impeller.

2. The suppressor as defined in claim 1 wherein said housing has an inlet and an outlet through which the toilet bowl liquid is forced to pass as said impeller is rotated within the liquid and has sidewalls positioned around said impeller and a bottom positioned below said impeller when said impeller is operatively positioned within the toilet bowl liquid, the opening in said sidewalls providing one of the inlet and the outlet and the opening in said bottom providing the other of said inlet and said outlet so that the motion of liquid moving through the housing reduces the likelihood of agitation of the upper surface of the liquid.

3. The suppressor as defined in claim 2 wherein the opening in said sidewalls provides said outlet and the opening in said bottom provides said inlet.

4. The suppressor as defined in claim 1 comprising means permitting the adjustment of the depth that the impeller is positioned within the toilet bowl liquid for controlling the turbulence of the liquid in the toilet bowl.

5. The suppressor of claim 1 for use in a toilet bowl having a rim wherein the suppressor further includes a mounting bracket connected to said rotating means for releasably attaching the rotation means, turbulence means and housing to the rim of the toilet bowl.

6. The suppressor as defined in claim 5 further including means permitting an adjustment of the depth of submergence of the impeller within the toilet bowl liquid for controlling the turbulence of the liquid in the toilet bowl.

7. A splash suppressor in combination with a toilet having a bowl, a seat hingedly movable relative to the bowl between a lowered condition at which the seat contacts and overlies the rim of the bowl and a raised condition, and a quantity of liquid contained within the bowl, said suppressor comprising:

turbulence means including a rotatable impeller for submergence within the liquid of the toilet bowl;

means for rotating said impeller when said impeller is submerged within the toilet bowl liquid so as to create hydraulic turbulence within the liquid and thereby suppress the splashing of liquid when a substance is dropped upon the upper surface of the liquid;

a housing associated with said turbulence means so as to encompass said impeller and having an inlet and an outlet through which liquid is forced to pass as said impeller is rotated; and switch means including a first switch operatively connected to said rotating means and cooperable with the seat of the toilet for activating said rotating means when the seat is raised from its lowered condition out of contact with the toilet bowl rim and deactivating the rotating means when the seat is lowered from its raised condition and into contact with the toilet bowl rim, said switch means including a second switch operatively connected to said rotating means permitting said rotating means to be manually actuated and de-actuated.

* * * * *